United States Patent [19]

Heyman

[11] 4,430,942

[45] Feb. 14, 1984

[54] MISSILE/CANISTER LATERAL SUPPORT PAD FLYOUT CONTROL SYSTEM

[75] Inventor: Roy J. Heyman, Littleton, Colo.

[73] Assignee: The United States of America as represented by the Secretary of the Air Force, Washington, D.C.

[21] Appl. No.: 318,655

[22] Filed: Nov. 5, 1981

[51] Int. Cl.[3] ..... F42B 13/16

[52] U.S. Cl. ..... 102/520; 89/1.819

[58] Field of Search ..... 102/374, 378, 377, 380, 102/513, 520–523, 530; 244/3.24, 3.25; 89/1.819, 145 B, 1 B

[56] References Cited

U.S. PATENT DOCUMENTS

| | | | |
|---|---|---|---|
| 36,773 | 10/1862 | Emery | 102/523 |
| 2,415,814 | 2/1947 | Davis et al. | 89/1 B |
| 2,998,780 | 9/1961 | Anspacher et al. | 102/523 |
| 3,038,382 | 6/1962 | Noyes et al. | 102/521 X |
| 3,044,400 | 7/1962 | Detwiler | 102/523 |
| 3,089,417 | 5/1963 | Beyer et al. | 89/1 B |
| 3,251,301 | 5/1966 | Herrmann | 102/49 |
| 4,145,017 | 3/1979 | Stiklorus | 244/3.25 |

*Primary Examiner*—Donald P. Walsh
*Assistant Examiner*—Tyrone Davis
*Attorney, Agent, or Firm*—Donald J. Singer; Stanton E. Collier

[57] ABSTRACT

An improved missile/canister support pad control system wherein rods having a flexible curved section are interconnected to the support pads and are detachably held parallel to the missile by releasing means. Upon command, after the missile leaves the canister, the releasing means allows the rods to spring away from the missile. The resultant wind in combination with the spring rods lifts and rotates the system away from the missile so as not to recontact the missile surface.

7 Claims, 7 Drawing Figures

MISSILE/CANISTER LATERAL SUPPORT PAD FLYOUT CONTROL SYSTEM

STATEMENT OF GOVERNMENT INTEREST

The invention described herein may be manufactured and used by or for the Government for governmental purposes without the payment of any royalty thereon.

BACKGROUND OF THE INVENTION

1. Field of the Invention.

This invention relates to missiles and, particularly, to an apparatus that insures that lateral support pads positioned between the missile and a canister that holds the missile before launching are separated in a controlled manner after launch.

2. Description of the Prior Art.

In general, canister launched missiles are ejected from the canister by expanding gases from a gas generator. The expanding gases push against a sabot-seal device positioned near the nozzle of the missile. The sabot-seal forms a gas tight seal between itself and the canister and further acts as a centering means of the missile within the canister. After a given interval of time from the firing of the gas generator, a firing signal ignites the missile motor. During ejection of the missile from the canister, supporting means insures that the missile and the canister do not damage either.

In particular, supporting means presently used in the MX system uses a plurality of lateral support pads around the missile which center and support the missile in the canister. The support pads are detachably held in place by releasing means until the firing signal releases the plurality of support pads. The support pads are arranged in annular sets having no connection between each set. Each set is held in place by the releasing means. Because the sets are not interconnected, it is likely that the support pads will recontact the missile skin or nozzle. The likelihood of this occurring increases greatly in windy launch conditions or when the missile is launched at an angle from the vertical.

Another method consists of canister mounted support pads deposed in a plurality of annular rings about the inside surface of the canister. Each annular set of pads has a lip seal which forms a gas seal between the pads and the missile surface. The sabot-seal as noted in the first method is not required since the pads form a seal and align the missile. One disadvantage is that a cold gas or steam eject launch is required since the first stage engine is exposed to the gas generator flow. Another disadvantage is that the stresses developed at the lip seals are unacceptable because they are cumulative.

Another method is a gas bearing approach using part of the gas generating efflux to drive orifices mounted in the canister surface surrounding the missile. The sabot-seal is still used in this method. Because of having the orifices in the walls and the high pressure gas therein, the canister has to have a strong wall structure. This further complicates the manufacturing of the canister as presently accomplished.

A still further method is a pad capture technique where the pads are picked off the missile as it exits the canister. This requires that the mechanism be deployed prior to launch and entails additional hardware to the presently existing canister.

SUMMARY OF THE INVENTION

The missile/canister support pad control system of this invention includes therein a network of interconnecting rods and support pads, releasing means, and a pivot ring, and thereby overcomes the problems encountered in the past and set forth in detail above.

During manufacturing of the rods, the rods being composed of flexible material, a curved section is formed such that each rod has a straight section and the curved section. The support pads are fixedly attached to the rods and the curved sections are sprung into alignment with the straight sections so that the rods are parallel to a longitudinal axis of the missile and are constrained in that position by releasing means.

Shortly after ejection of the missile from the canister, a firing signal, for example, actuates releasing means causing the curved sections of the rods to spring away from the missile's surface. The curved sections are installed so that the curved sections are close to the nose of the missile and spring radially away from the missile's longitudinal axis. The air stream further causes a lifting effect radially since the pads are at a positive angle to the direction of the missile's flight. In combination, the springing of the rods and the lifting of the pads by the air stream cause all of the support parts to separate from the missile in a controlled manner analogous to the peeling of a bananna.

The ends of the straight sections, being closest to the nozzle, are connected to a pivot ring by connecting means. This ring insures the controlled separation of the network. It also separates as the sabot-seal separates.

One object of the invention is a missile/canister support pad control system which insures that support pad separation occurs without recontact with the missile.

Another object is a missile/canister support pad control system that eliminates ring stress problems.

A further object of the invention is a missile/canister support pad control system that minimizes changes to existing missile or canister design or to support pads, sabot-seal, gas generator, or deployment procedures.

A still further object is a missile/canister support pad control system able to function at launching angles varying from about 45° to the vertical.

Other objects, advantages, and novel features of the invention will become apparent from the following detailed description of the invention when considered in conjunction with the accompanying drawings and claims.

DESCRIPTION OF THE PREFERRED EMBODIMENT

Figure 1:
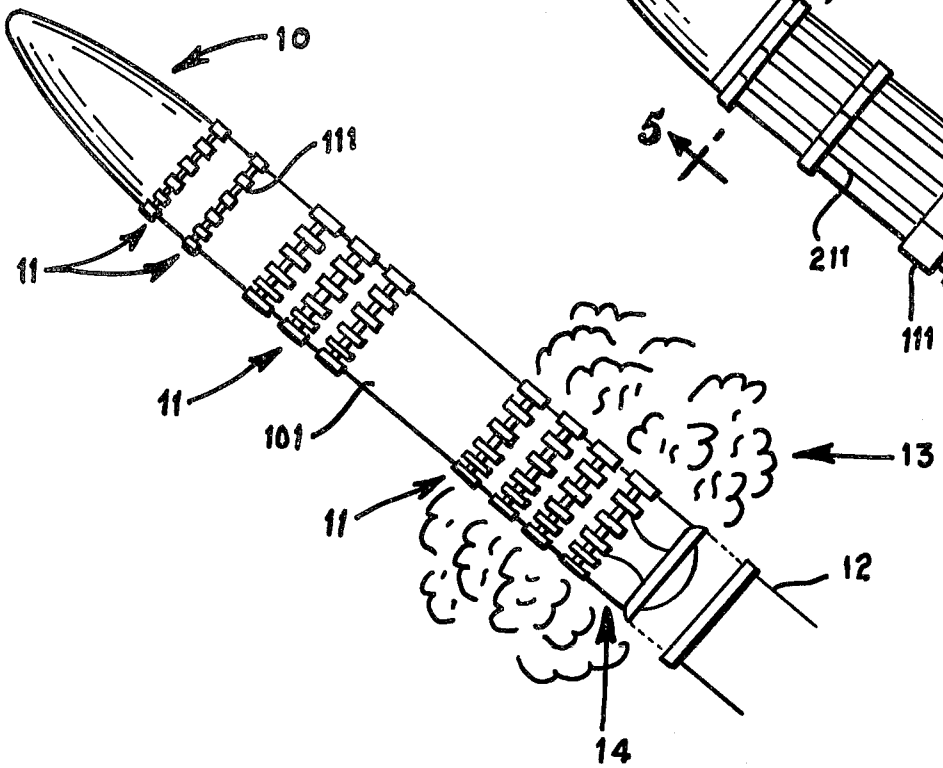
FIG. 1 PRIOR ART
FIG. 1 depicts by a side view a prior art missile/canister support pad control system.

In order to better understand the present invention, a detailed explanation follows with reference to a typical prior art support system as shown in FIG. 1 of the drawing. As illustrated therein a missile 10 has a plurality of support pads 11 detachably secured to missile 10 by releasing means, not shown. Missile 10 is ejected from a canister 12 by expanding gases 13 from a gas generator, not shown. Expanding gases 13 push against a sabot-seal 14 positioned on the nozzle end of missile 10. Sabot-seal 14 forms a gas tight seal between itself and the inside of canister 12, and further acts as a centering means of missile 10 within canister 12. Upon discharge of missile 10 from canister 12, sabot-seal 14 separates from missile 10. After a given interval of time from firing of the gas generator including the separation of sabot-seal 14, a firing signal ignites the missile motor. The firing signal also actuates the releasing means so that each support pad 11 falls from missile's 10 surface independent of each other. Releasing means can be either a spring releasing means or an ordinance releasing means. The important factor being that support pads 11 are removed after missile 10 leaves canister 12 in a controlled manner.

Since each individual support pad 11 is only connected to the adjacent lateral pads, it is very likely that support pads 11 will recontact a missile skin 101 or an engine nozzle, not shown. The likelihood of this occurring increases greatly in windy launch conditions or when missile 10 is launched at an angle from the vertical.

Figure 2:
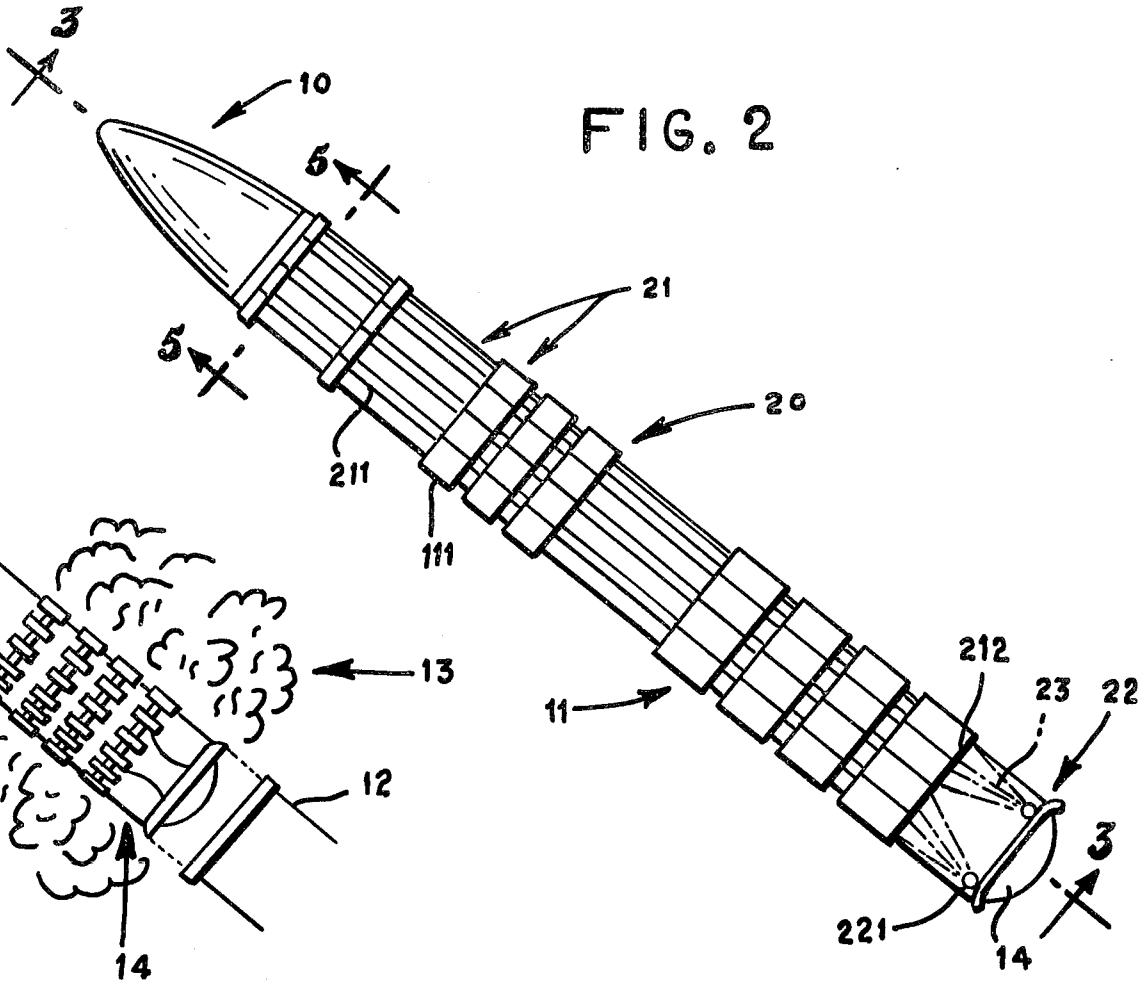
FIG. 2 depicts by a side view a missile with the missile/canister support pad control system of this invention.

FIG. 2 illustrates missile 10 with the improved missile/canister support pad control system 20 of this invention incorporated therewith. System 20 is composed of a network 21 of interconnecting rods 211 and lateral support pads 11, releasing means 50, shown in FIG. 5, and a pivot ring 22.

Lateral support pads 11 are detachably disposed in the same positions as the prior art, and are conventional and therefore are designated by the same numeral as in prior art FIG. 1. For ease of understanding of this invention, however, a plurality of support pads will hereinafter be designated by number 11 while each individual pad will be referred to by numeral 111. Each support pad 111 has two rods 211 traversing longitudinally each pad 111 as shown in FIG. 2. Each pad 111 is about 2 inches thick with a maximum compression of about 1 inch during shock. Pads 11 are fixedly attached to rods 211 and are assembled into subnetworks 40 by attaching three longitudinal columns together, illustrated in FIG. 4.

Connecting means 23, shown in FIG. 2, secure each rod end 212 to a pivot 221 of pivot ring 22. Pivot ring 22 is an annular band held by releasing means to sabot-seal 14. Upon release ring 22 divides into 4 sectons. Each section having one pivot. Connecting means 23 are rotatably secured to pivots 221 so that each subnetwork 40 may rotate about pivots 221, even after ring 22 divides. Connecting means 23 can be flexible wires of sufficient strength to resist breaking before pivot ring 22 separates. In this embodiment, 6 rods 211 are connected to each pivot 221, there being 4 pivots 221. Pivot ring 22 separates into 4 sections, shaped as quarter circles, after subnetworks 40 have developed sufficient lift away from missile 10. A pivot ring releasing means determines the occurrence of this criteria and detachably secures ring 22 to sabot-seal 14. To further understand the action of network 20, refer to FIG. 3. Each rod 211 has a straight section 2111 and a curved section 2112. Curved section 2112 being closest to a missile nose cone 15.

Curved section 2112 as formed in manufacturing is shaped essentially like a quarter section of a circle and when aligned with the straight section is approximately one quarter of the combined length. Calculations have shown that the required spring force is obtained with steel rods as small as one half inch by one half inch in cross-section for each longitudinal column of pads or graphic-epoxy rods as small as one half inch by three quarter inch in cross-section.

Figure 3:
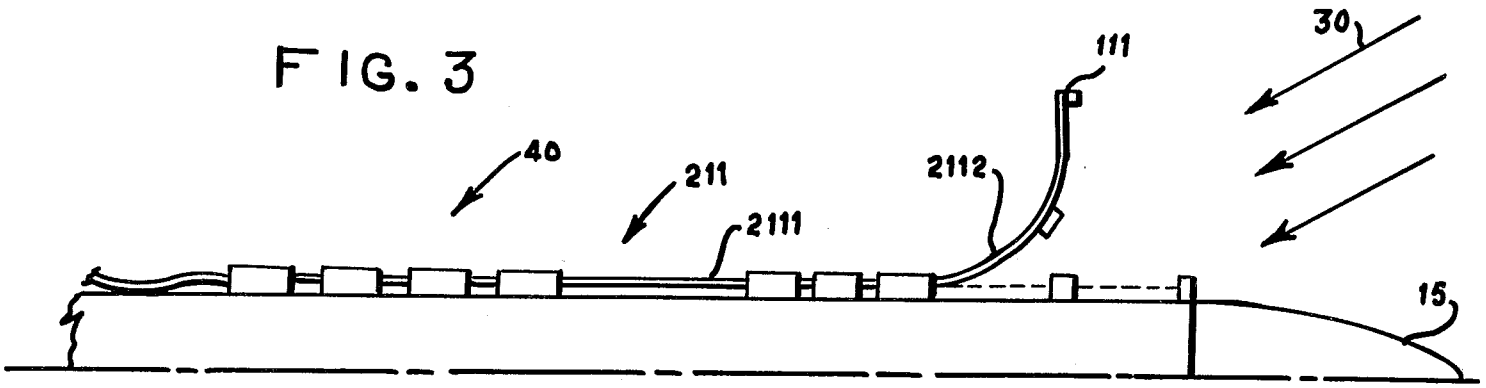
FIG. 3 depicts by a partial cross-section taken along lines 3—3 of FIG. 2 one rod in the unsprung position with the support pads attached.

Curved section 2112 interacts with a resultant wind vector 30 as shown in FIG. 3. Missile/canister support pad system 20 must be capable of performing a launch in surface winds at approximately 45 feet per second. Resultant wind vector 30 is the sum of the missile velocity of approximately 130 feet per second, varying between vertical and 45°, and the wind velocity. This resultant wind vector 30 is incident upon missile 10 from 20° to 30°. As seen in FIG. 3, resultant wind vector 30 causes a lifting force on pads 11 attached to curved section 2112. This in combination with the spring force of curved section 2112 initially lifts subnetwork 40 away from missile 10 as desired. As subnetwork 40 is further lifted away from missle 10, additional lifting results when wind vector 30 strikes pads 11 on straight section 2111 of subnetwork. The overall effect is to peel subnetworks 40 off of missile 10 as peeling the skin of a banana.

Figure 4:
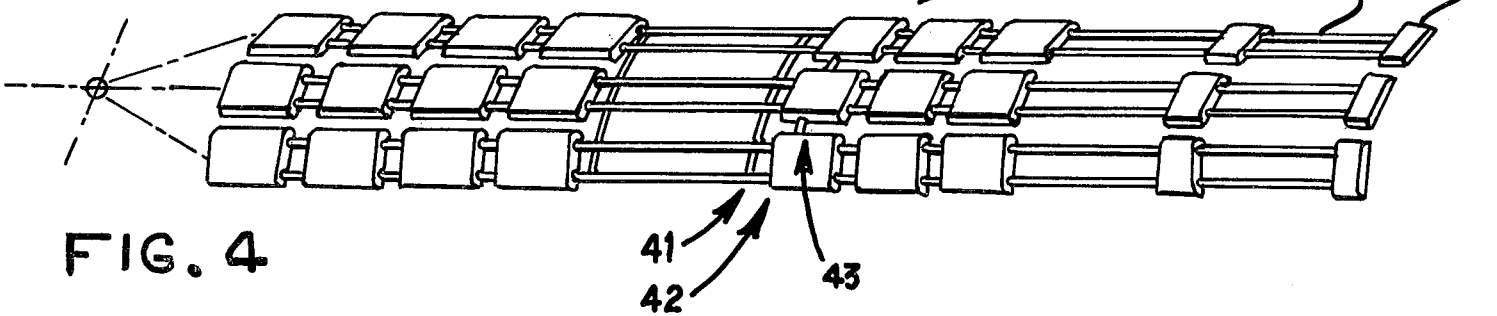
FIG. 4 depicts by an isometric view a subnetwork of the missile/canister support pad control system.

Subnetworks 40 is illustrated in FIG. 4. Subnetworks 40 is composed of 6 columns of rods 211 with 3 rows of pads 11 connected together by linking means 42 such as a bar as shown at 41 connected to rods 211 or a bar, connected between support pads as shown at 43. Four subnetworks 40 are placed on missile 10, one in each quadrant. The number is only used as illustrative example and can vary in accordance with the invention.

Figure 5:
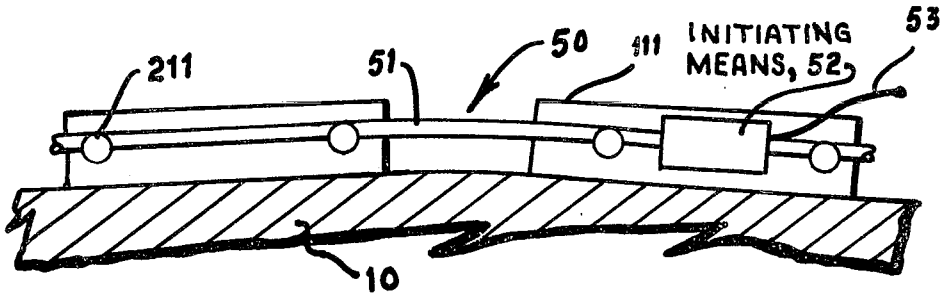
FIG. 5 depicts by a partial cross-section of the missile taken along lines 5—5 of FIG. 2 the releasing means.

Subnetwork 40 is held detachably in place by releasing means 50 shown in FIG. 5. Releasing means 50 is composed of a cable 51 and initiating means 52. Initiation means 52 could be a conventional off-center cam device that is tripped when it leaves canister 12 or a conventional ordinance device that is triggered by a signal over input wire 53. Either way, cable 51 is severed by initiating means 52. There may be several initiating means 52 on each cable 51 to insure that the cable 51 is cut. Cable 51 circulates a circumference of missile 10 and is held in place by tension in cable 51 and notches placed in rods 211.

A similar releasing means is used to separate pivot ring 22 after each subnetwork 40 has partially lifted away from missile 10.

Figure 6:
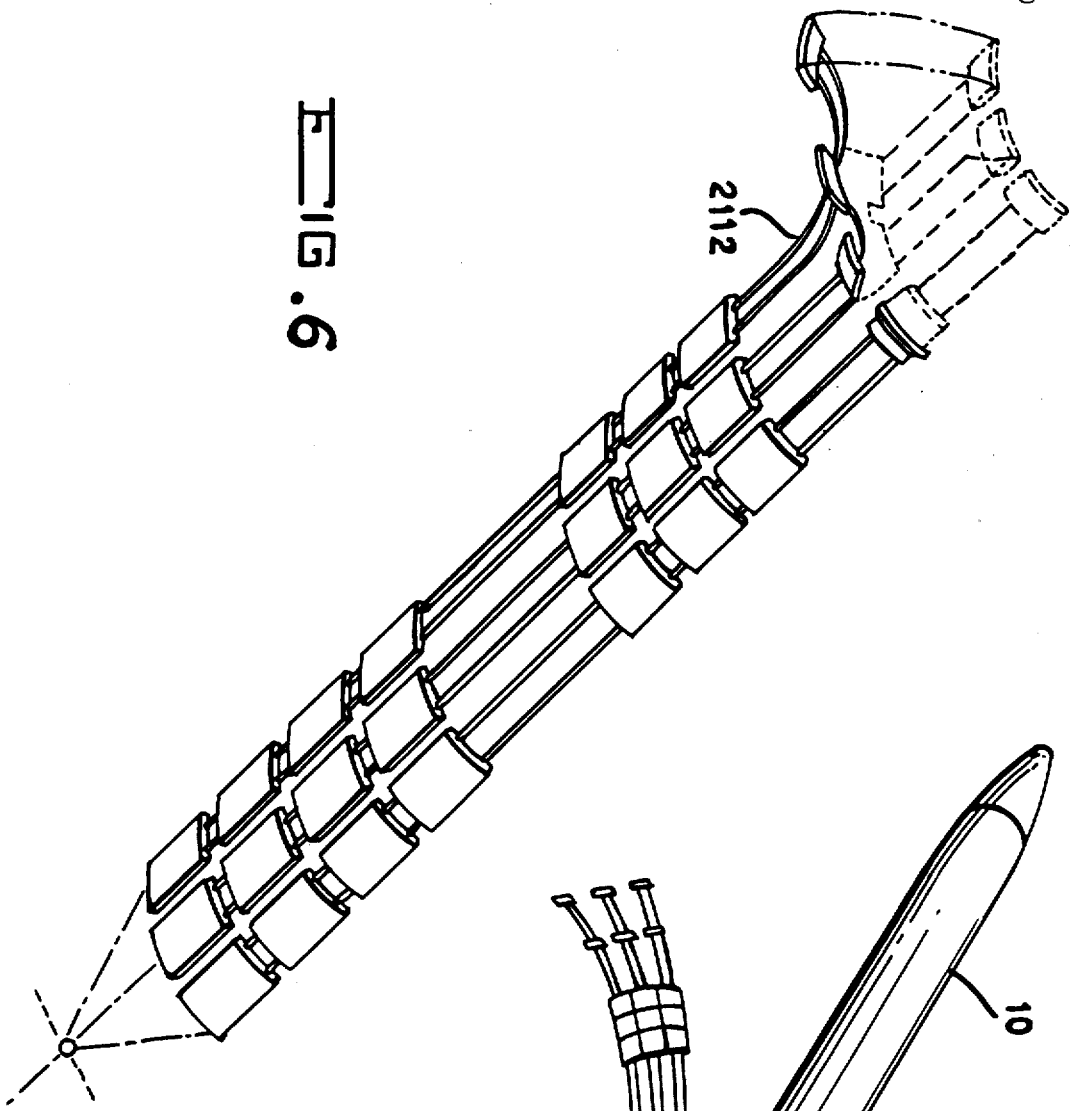
FIG. 6 depicts by an isometric view the springing of subnetwork of rods and support pads.

When releasing means 50 holding curved section 2112 is activated, curved sections 2112 spring away from missile 10 as shown in FIG. 6, missile 10 not shown.

A nimimum number of releasing means 50 for support pad control system is 4. One holds curved sections 2112 to missile 10. Two hold straight sections 2111 and another holds pivot ring 22.

MODE OF OPERATION

The operation of support pad control system 20 in the preferred embodiment is shown in several figures. Missile 10 having missile/canister support pad control system 20, FIG. 2, is ejected from canister 12 by a gas generator efflux, FIG. 1.

After missile 10 has cleared canister 12, the firing signal from a missile's electronic system actuates initiating means 52. Initiating means 52 severs cables 51, FIG. 5, located about circumferences of missile 10.

Figure 7:
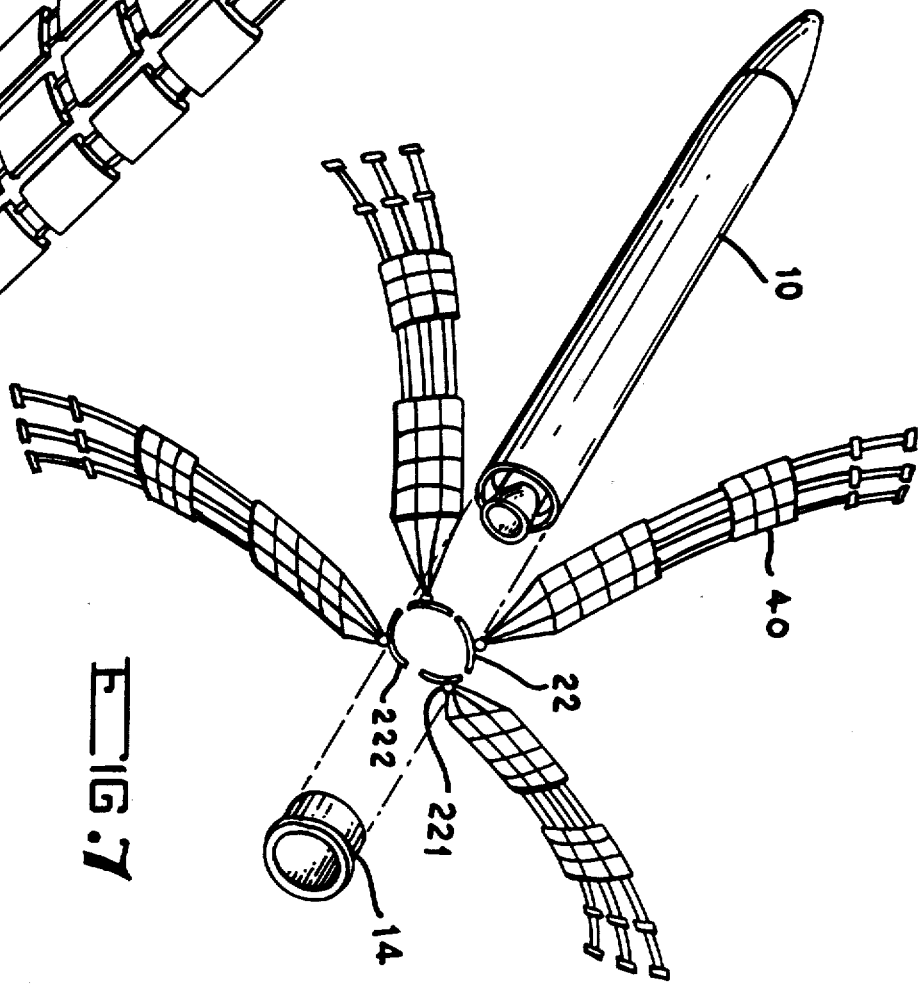
FIG. 7 depicts by an isometric view the separation of the missile/canister support pad control system and sabot-seal from the missile after launch.

Curved sections 2112 of rods 211 spring away from missile 10 and are exposed to an air stream which furthers lifts subnetworks 40 away from missile 10, FIG. 6. The combined effects of the springing action, the air stream pressure, and the inertia of subnetworks 40 cause each subnetwork 40 to rotate about pivots 221 at pivot ring 22. Pivot ring 22 separates into sections 222 equal in number to subnetworks 40. This insures that each subnetwork 40 rotates about pivot point 221 without interferring with other subnetworks 40 since not all subnetwork 40 are rotating at the same rate. The movement of subnetworks 40 away from missile 10 is shown in FIG. 7.

It is to be noted that although there have been described the fundamental and unique features of my invention as applied to a preferred embodiment, various other embodiments, variations, adaptations, substitutions, additions, omissions, and the like may occur to, and can be made by, those of ordinary skill in the art, without departing from the spirit of the invention.

What is claimed is:

1. An improved missle/canister support pad control system for insuring proper alignment of a missile in a canister and for removing upon flyout a plurality of support pads detachably mounted to a side of said missile and in sliding contact with said canister, said missile having a sabot-seal that contains efflux from a gas generator during a low velocity launch, said support pad control system comprising:

a network of rods longitudinally disposed on said side of said missile, said rods having said support pads fixedly mounted thereon, each of said rods having a naturally straight section proximal to a nozzle of said missile and a naturally curved section proximal to a missile nose, whereby in a released position said curved section arches away from said missile, said curved section having a shape of about a quarter circle;

a pivot ring detachably secured to said missile near said nozzle;

means for connecting said network to said pivot ring; and means for releasing said network and said pivot from said missile after flyout.

2. An improved missile/canister support pad control system as defined in claim 1 wherein said network is composed of a plurality of subnetworks, each of said networks having a plurality of columns, each of said columns having at least one of said rods and a plurality of said support pads fixedly attached, each of said columns in said subnetworks connected by linking means whereby columns in said subnetwork are physically connected together and independent of other of said subnetworks.

3. An improved missile/canister suport pad control system as defined in claim 2 wherein two of said rods are in each of said columns and said network comprises four subnetworks, each subnetwork having three of said columns.

4. A missile/canister support pad control system as defined in claim 3 wherein said rods are made of steel having a cross-section of about one half inch by one half inch.

5. A missle/canister support pad control system as defined in claim 3 wherein said rods are made of graphite-epoxy with a cross section of about one-half inch by three quarter inch.

6. An improved missile/canister support pad control system as defined in claim 2 wherein said pivot ring has a plurality of sections equal in number to the number of said subnetworks, each of said sections having a pivot thereon, each of said pivots connected to only one of said subnetworks by said means for connecting, said means for connecting further including cables connected to the ends of each of said straight sections and said pivots.

7. An improved missile/canister support pad control system as defined in claim 1 wherein said means for releasing comprises cables and means for initiating release of said network, each cable circumscribing said missile to form a ring and resting under tension in said rods, each of said cables having a plurality of said initiating means mounted thereon to insure that the cable is severed upon command after said missile achieves a predetermined velocity after flyout whereby said subnetworks fall away from said missile without contact therewith.

* * * * *

UNITED STATES PATENT AND TRADEMARK OFFICE

CERTIFICATE OF CORRECTION

PATENT NO. : 4,430,942

DATED : 14 February 1984

INVENTOR(S) : Roy J. Heyman

It is certified that error appears in the above-identified patent and that said Letters Patent are hereby corrected as shown below:

On the first sheet of the drawings, in the first line, in "Sheet 1 of 2", "2" should be changed to --3--.

On the second sheet of the drawings, in the first line, in "Sheet 2 of 2", the second "2" should be changed to --3--.

Sheet 3 of the drawings containing Figs. 6 and 7 should appear as shown on the attached sheet.

Signed and Sealed this

*Twenty-first* Day of *August 1984*

[SEAL]

*Attest:*

GERALD J. MOSSINGHOFF

*Attesting Officer* *Commissioner of Patents and Trademarks*